United States Patent [19]

Chaplin

[11] 4,337,016

[45] Jun. 29, 1982

[54] DUAL WALL SEAL MEANS

[75] Inventor: Gary F. Chaplin, Vernon, Conn.

[73] Assignee: United Technologies Corporation, Hartford, Conn.

[21] Appl. No.: 103,007

[22] Filed: Dec. 13, 1979

[51] Int. Cl.[3] ..... F01D 5/18

[52] U.S. Cl. ..... 415/116; 415/128; 415/138; 415/174

[58] Field of Search ..... 415/115, 116, 128, 134, 415/135, 136, 138, 174

[56] References Cited

U.S. PATENT DOCUMENTS

| | | | |
|---|---|---|---|
| 3,836,279 | 9/1974 | Lee | 415/116 |
| 3,844,343 | 10/1974 | Burggraf | 415/115 |
| 4,069,662 | 1/1978 | Redinger et al. | 415/116 |

*Primary Examiner*—Robert E. Garrett

*Attorney, Agent, or Firm*—Gene D. Fleischhauer

[57] ABSTRACT

Apparatus for confining cooling air to a flowpath between an outer case and adjacent structure is disclosed. Various construction details which enable the means to sealingly engage the adjacent structure to block the leakage of cooling air and to accommodate changes in diameter are discussed. The means has dual walls which are segmented.

7 Claims, 4 Drawing Figures

DUAL WALL SEAL MEANS

BACKGROUND OF THE INVENTION

1. Field of the Invention

This invention relates to gas turbine engines, and more particularly to means for confining cooling air to a flowpath extending about the interior of the outer case of such an engine.

2. Description of the Prior Art

A gas turbine engine has a compression section, a combustion section and a turbine section. The turbine section has a rotor assembly and a stator assembly. An annular flowpath for working medium gases extends axially through the engine. The annular flowpath passes in alternating succession between components of the stator assembly and components of the rotor assembly. The rotor assembly includes a plurality of outwardly extending rotor blades. The rotor blades extend into the working medium flowpath and into proximity with components of the stator assembly. To confine the working medium gases to the working medium flowpath a plurality of outer air seal segments radially oppose the tips of the rotor blade. The outer air seals are part of the stator assembly. An outer case and support structure extending inwardly from the outer case support and position the outer air seals about the tips of the rotor blades.

Because the outer air seals, the outer case, and the rotor blades expand and contract at different rates in response to changes in temperatures of the hot working medium gases, the clearance between the tips of the rotor blades and the outer air seal varies. To minimize the clearance during steady-state conditions such as at cruise, cooling air is discharged against the outer case from cooling tubes circumscribing the case to cause the case to contract. The contracting case displaces the outer air seals inwardly to a smaller diameter. The inward movement of the outer air seals decreases the clearance between the rotor tips and the outer air seals with a concomitant beneficial effect on engine efficiency. One such construction directed to such a structure is shown in U.S. Pat. No. 4,069,320 to Redinger et al. entitled, "Clearance Control For Gas Turbine Engine".

In modern engines, cooling air is also flowed through passages on the interior of the case. The cooling air removes heat from the case and from the outer air seals which are in intimate contact with the hot working medium gases to increase the service life of such components. Along the cooling air flowpath, the cooling air is at a higher pressure than the surrounding gases. The case forms the outer boundary of the cooling air flowpath and seal means extend between the cooling air flowpath and the hot gases to form an inner boundary of the flowpath. Holes through the seal means face a corresponding cavity in the outer air seal and precisely meter the flow of cooling air into the cavity. Cooling air leakage around the edges of such seal means degrades engine performance. One example of a design directed to a construction which meters cooling air to outer air seal cavities and which blocks the leakage of cooling air around the ends of the seal means is shown in U.S. Pat. No. 3,583,824 to Smuland entitled, "Temperature Controlled Shroud and Shroud Support". The seal means of Smuland is welded or brazed to the outer air seal. U.S. Pat. No. 3,836,279 to Lee entitled, "Seal Means for Blade and Shroud" discloses a circumferentially extending sheet metal shroud seal. The seal has a plurality of openings each of which faces a corresponding cavity in an outer air seal. A raised portion extends around each opening and is resiliently deformed to provide an annular seal around the opening.

Notwithstanding the above art, scientists and engineers are still seeking to increase the sealing effectiveness of a seal means extending about the interior of an engine case between an outer case and the hot working medium gases and, in particular, between the outer case and an array of outer air seals.

SUMMARY OF THE INVENTION

A primary object of the present invention is to increase the sealing effectiveness of a seal means defining a cooling air flowpath between a working medium flowpath and the outer case. Another object is to set the diameter of the ring in operative response to changes in diameter of the outer case. A further object is to ensure an effective fatigue life of the seal structure. In one embodiment, an object is to increase the sealing effectiveness of a seal means defining a cooling air flowpath between an array of outer air seals and the outer case.

According to the present invention, a segmented means for sealing having dual walls is positioned radially by an outer case between the case and a working medium flowpath to define a cooling air flowpath between the means for sealing and the outer case.

A primary feature of the present invention is the segmented seal means having dual walls. The segmented seal means has a segmented inner wall and a segmented outer wall. Another feature is the ring-like shape of the seal means. The segments of the outer wall radially face the segments of the inner wall. The inner wall segments are circumferentially spaced one from another leaving an expansion gap therebetween. The outer wall segments are similarly spaced. In one embodiment the expansion gaps of the inner wall are offset with respect to the expansion gaps of the outer wall. Other features are an upstream support hoop and a downstream support hoop extending inwardly from the outer case to engage the outer air seal and the segmented seal means. In one embodiment, the inner wall of each segment is trapped between the support hoops and an outer air seal. A pin extends through each segment of the segmented seal means and the support hoop.

A principal advantage of the present invention is the effective seal which results from the engagement between the support hoops and the dual walls of the segmented seal means. Circumferential gaps between adjacent wall segments are decreased in operative response to decreases in the diameter of the case. An adequate fatigue life is ensured by the sliding engagement between adjacent segments of the segmented ring and between the segmented ring and the support hoops. Differential rates of thermal expansion are accommodated by providing an expansion gap to the segments of the dual wall structure. In one embodiment, radial leakage of the cooling air is further decreased by offsetting the gaps.

The foregoing and other objects, features and advantages of the present invention will become more apparent in the light of the following detailed description of preferred embodiments thereof as discussed and illustrated in the accompanying drawing.

DETAILED DESCRIPTION

Figure 1:
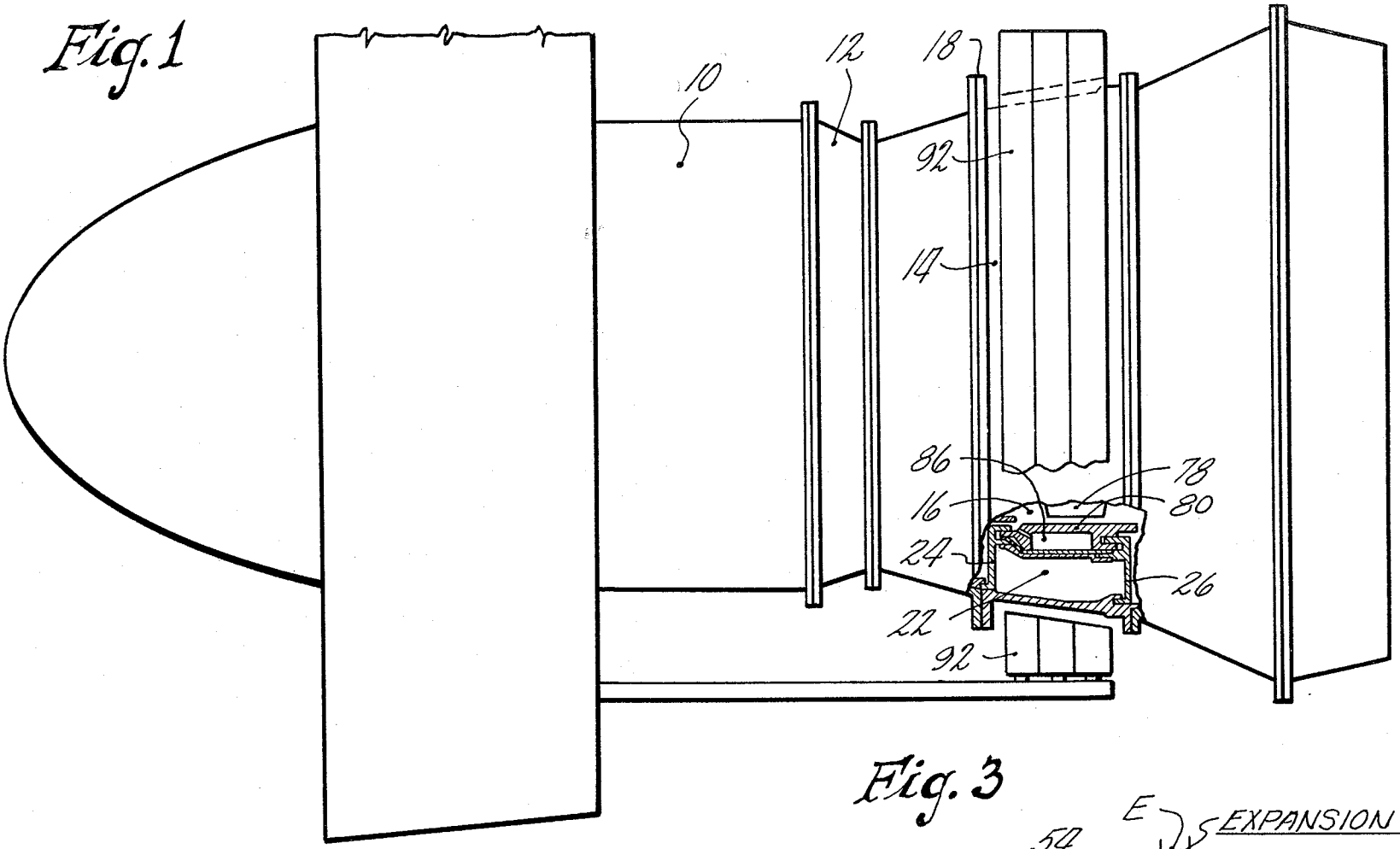
FIG. 1 is a simplified, side elevation view of a turbofan engine with a portion of an outer case broken away to reveal internal structures positioned by the case and a seal means extending therebetween.

A gas turbine engine embodiment of the invention is illustrated in FIG. 1. The principal sections of the engine include a compression section 10, a combustion section 12 and a turbine section 14. An annular flowpath 16 for working medium gases extends axially through the engine. An outer case 18 circumscribes the flowpath for hot working medium gases. In the turbine section, a flowpath 22 for cooling air extends between the outer case and the hot working medium gases.

Figure 2:
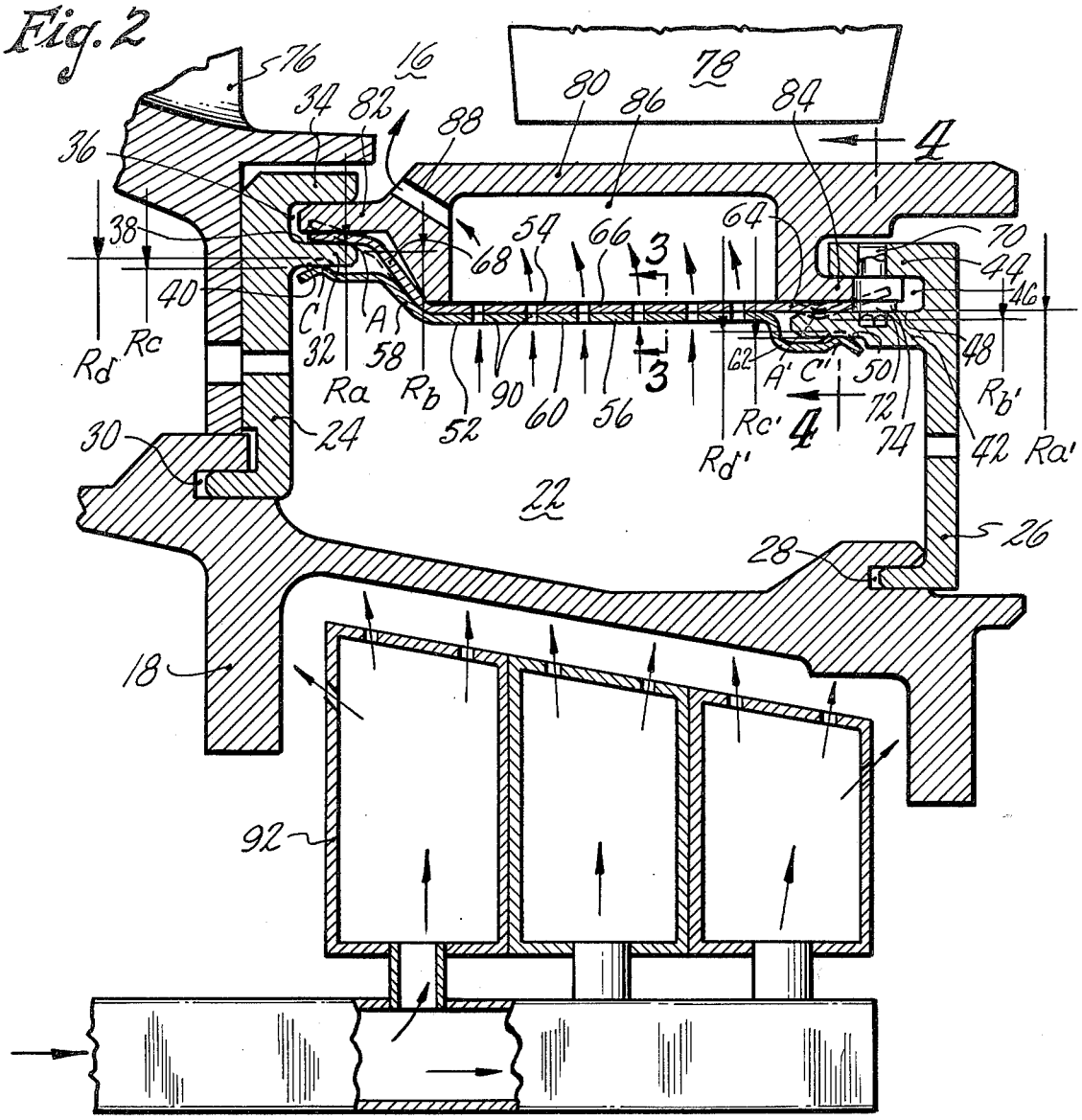
FIG. 2 is an enlarged sectional view of a portion of the outer case, the internal structures positioned by the outer case and a seal means extending therebetween.

FIG. 2 is an enlarged sectional view of a portion of the turbine section 14. A first element, such as upstream support hoop 24, and a second element spaced axially from the first element, such as downstream support hoop 26, extending inwardly from the outer case. The outer case is adapted by a downstream groove 28 to receive the downstream support hoop and by an upstream groove 30 to receive the upstream support hoop. As those skilled in the art will realize the upstream and downstream support hoops may be continuous rings or segmented rings. The upstream support hoop has an outer flange 32 and an inner flange 34. The inner flange is radially spaced from the outer flange leaving a rearwardly facing groove 36 therebetween. The outer flange has an inner surface 38 and an outer surface 40. Similarly, the downstream support hoop has an outer flange 42 and an inner flange 44. The inner flange is radially spaced from the outer flange leaving a forwardly facing groove 46 therebetween. The outer flange has an inner surface 48 and an outer surface 50.

Means for sealing and metering cooling air, such as a segmented ring 52, extends between the outer flange 32 on the upstream support hoop 24 and the outer flange 42 on the downstream support hoop 26. The segmented ring has a segmented inner wall 54 and a segmented outer wall 56. Each segment of the outer wall has an upstream end 58, a center section 60 and a downstream end 62. Each segment of the inner wall has a downstream end 64, a center section 66 and an upstream end 68. The center section of each segment of the outer wall is attached, for example by welding or other suitable means, to the center section of a single segment of the inner wall. A pin 70 penetrates the downstream support hoop and the inner wall. The inner wall is adapted by a slot 72 extending axially to receive the pin at a spline-type connection 74.

The free position of the outer wall and the inner wall at the upstream end and at the downstream end are shown by the dotted lines. At the upstream support hoop 24 in the installed position, the inner wall presses against the inner surface 38 to exert a sealing force along a line of sealing contact A, the line having a radius $R_a$ about the axis of the engine and a radius $R_b$ in the free state. The outer wall presses against the outer surface 40 to exert a sealing force along a line of sealing contact C, the line having a radius $R_c$ about the axis of the engine and a radius $R_d$ in the free state. The difference between $R_c$ and $R_a$ is greater than the difference between $R_d$ and $R_b$ causing an interference fit between the flange and the inner and outer walls, i.e. $[R_c-R_a]>[R_d-R_b]$. Similarly at the downstream support hoop 26, the inner wall presses against the inner surface 48 to exert a sealing force along the line of sealing contact A', the line having a radius $R_a'$ about the axis of the engine and a radius $R_b'$ in the free state. The outer wall presses against the outer surface 50 of the outer flange 42 to exert a sealing force along a line of sealing contact C', the line having a radius $R_c'$ about the axis of the engine and a radius $R_d'$ in the free state. The difference between $R_c'$ and $R_a'$ is greater than the difference between $R_d'$ and $R_b'$ causing an interference fit between the flange and the inner and outer walls, i.e. $[R_c'-R_a']>[R_d'-R_b']$.

An array of vanes, as represented by the single vane 76, extends inwardly from the outer case into the working medium flowpath 16. An array of rotor blades, as represented by the single rotor blade 78, extends outwardly into the working medium flowpath into proximity with the outer case 18. A plurality of outer air seals, as represented by the single outer air seal 80, radially oppose the rotor blades. Each outer air seal has an upstream tongue 82 and a downstream tongue 84. The upstream tongue projects into the groove 36 and traps the inner wall between the outer air seal and the upstream support hoop. Similarly the downstream tongue 84 projects into the groove 46 and traps the inner wall between the seal and the downstream support hoop.

Each outer air seal 80 has a cooling air cavity 86 and a cooling air exit hole 88. A plurality of holes 90 in the center section 60 of each segment of the ring 52 are in gas communication with the cooling air cavity and the cooling air flowpath 22.

A plurality of external cooling air tubes 92 circumscribes the outer case 18. A source of cooling air at an upstream location, such as compression section 10, is in flow communication with the tubes.

Figure 3:
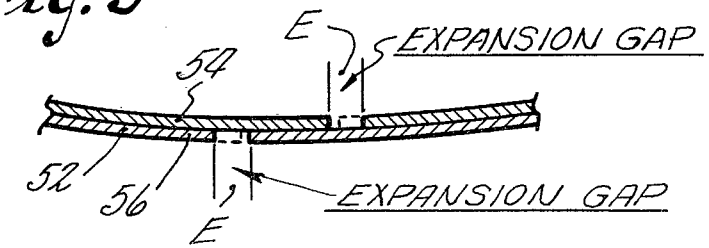
FIG. 3 is a sectional view of the seal means taken along the lines 3—3 as shown in FIG. 2.

FIG. 3 is a sectional view of the segmented ring 52. Each outer wall circumferentially overlaps an inner wall of an adjacent segment. Each segment is circumferentially spaced from the adjacent segment leaving an expansion gap E therebetween.

Figure 4:
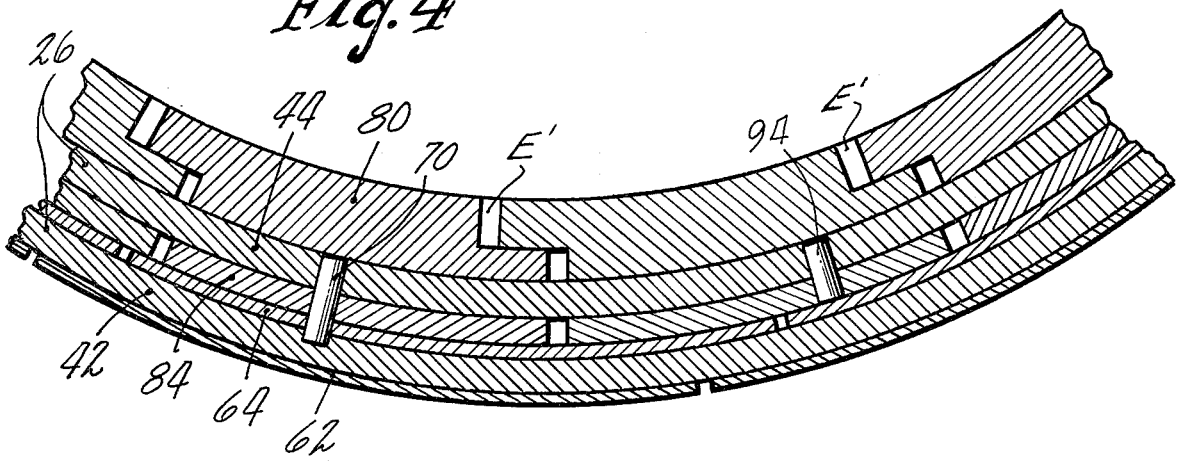
FIG. 4 is a sectional view taken along the lines 4—4 as shown in FIG. 2.

FIG. 4 is a directional view along the line 4—4 of FIG. 2. Each outer air seal is spaced circumferentially and overlaps the adjacent outer air seal leaving an expansion gap E' therebetween. In the absence of a pin 70, a pin 94 penetrates the inner flange 44 of downstream support hoop 26 and the tongue 84 of a corresponding outer air seal 80.

During operation of a gas turbine engine, the hot working medium gases and cooling air enter the turbine section 14 of the engine. The hot working medium gases follow the flowpath 16 into the turbine section. Components of the turbine section, including the outer air seal 80, the segmented ring 52, the outer case 18 and structure positioned by the case, such as upstream support hoop 24 and downstream support hoop 26 are heated by the working medium gases. High pressure cooling air following the flowpath 22 is flowed through the holes 90 in the segmented ring to enter the plurality of cooling air cavities 86 in each outer air seal. The cooling air is flowed out of the cooling air cavity through the exit holes 88 and provides film cooling to the outer air seal.

The components of the engine respond thermally at different rates to heating by the working medium gases and cooling by the cooling air. The outer air seal 80 and the segmented ring 52 have a thermal capacitance that is much smaller than the thermal capacitance of the outer case 18. The outer air seal and the segmented ring are also in closer proximity to the hot working medium gases 16 than is the outer case. Accordingly the outer air seal and the segmented ring respond more quickly to changes in gas path temperature than does the outer case. An increase in the temperature of the hot working medium gases, such as occurs during accelerations and startup, causes the array of outer air seals and the segmented ring to expand circumferentially decreasing the circumferential gaps between adjacent outer air seals and adjacent ring segments. The outer air seal and the segmented ring are maintained at a radius dependent on the position of the turbine case which determines the position of the pins 70 and 94. Locating these pins at the circumferential midpoint of each outer air seal causes the circumferential ends of each of these components to move equally. As those skilled in the art will appreciate these pins may be located away from the circumferential midpoint of the sections causing the circumferential ends to move unequally in response to thermal growth.

The inner wall 54 of each seal segment presses the outer air seal 80 tightly against the inner flange 34 of the upstream support hoop 24 and the inner flange 44 of the downstream support hoop 26. Correspondingly, the upstream tongue 82 and the downstream tongue 84 of the outer air seal press against the inner wall to exert a spring-type sealing force along sealing contact line A and sealing contact line A'.

Each outer air seal 80 and each segment of the sealing ring also expands axially during startup and accelerations. As the seal means expands axially the sealing contact line A and A' slide axially along the inner surface 38 of the outer flange 32 and along the inner surface 48 of the outer flange 42. In addition to the spring-type contact force supplied by the outer wall along the sealing contact lines C and C' on the outer surface 40 of the outer flange 32 and the outer surface 50 of the outer flange 42, the high pressure cooling air 22 urges the outer wall inwardly causing the outer wall to press tightly against the outer flanges.

The outer case 18 and adjacent structure such as the upstream support hoop 24 and the downstream support hoop 26 responds more slowly than does the array of outer air seals 80 and the segmented ring 52. The case reaches a steady-state position after these components. Before the case reaches a steady-state condition, the case grows outwardly with respect to the centerline of the engine and causes the array of outer air seal segments and the segmented ring 52 to move to a larger diameter. The outer air seal segments and the segments of the segmented rings slide circumferentially with respect to each other causing the expansion gaps E and E' to increase.

At cruise, the clearance between the ends of the rotor blades 78 and the outer air seal 80 is excessive and decreases the operating efficiency of the engine. Cooling air from an upstream location such as the compression section 10 is flowed through the cooling air tubes 92 and caused to impinge the outer cases. The outer case contracts causing the case to decrease in diameter. The outer air seals and the segmented rings slide circumferentially with respect to each other. The expansion gaps grow smaller, and the diameter of the outer air seal decreases until the steady-state operating clearance at cruise between the blade tips and the outer air seal is reached.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. For a gas turbine engine having an annular flowpath for working medium gases extending axially through the engine and an annular flowpath for cooling air spaced radially outwardly of the working medium flowpath, a structure for confining the cooling air to the cooling air flowpath which comprises:

an outer case circumscribing the cooling air flowpath;

a first element extending inwardly from the outer case;

a second element extending inwardly from the outer case and spaced axially from the first element; and, a means disposed between the cooling air flowpath and the working medium flowpath for preventing the leakage of cooling air between said first element and said second element, the means including an inner wall comprised of a plurality of circumferentially adjacent segments which are engaged by the first element and the second element to form a seal at the inner wall, an outer wall comprised of a plurality of circumferentially adjacent segments which are engaged by the first element and the second element to form a seal at the outer wall;

wherein a portion of the first element extends between the inner wall and the outer wall to engage the inner wall and the outer wall, wherein a portion of the second element extends between the inner wall and the outer wall to engage the inner wall and the outer wall and wherein the engagement of the inner and outer walls by the first and second elements sets the diameter of the seal means in operative response to changes in diameter of the outer case.

2. For a gas turbine engine having an annular flowpath for working medium gases extending axially through the engine and an annular flowpath for cooling air spaced radially outwardly of the working medium flowpath, a structure for confining the cooling air to the cooling air flowpath which comprises:

an outer case circumscribing the cooling air flowpath;

a first element extending inwardly from the outer case and having a flange;

a second element extending inwardly from the outer case and spaced axially from the first element; and, a means disposed between the cooling air flowpath and the working medium flowpath for preventing the leakage of cooling air between said first element and said second element, the means including an inner wall comprised of a plurality of circumferentially adjacent segments which are engaged by the first element and the second element to form a seal at the inner wall, the inner wall having a line of sealing contact which engages the flange of the first element, the line having a radius $R_a$ about the axis of the engine in the installed position and a radius $R_b$ in the free state, an outer wall comprised of a plurality of circumferentially adjacent segments which are engaged by the first element and the second element to form a seal at the outer wall, the outer wall having a line of sealing contact which engages the flange of the first element, the line having a radius $R_c$ about the axis of the engine in the installed position and a radius $R_d$ in the free state;

wherein the difference between $R_c$ and $R_a$ is greater than the difference between $R_d$ and $R_b$ ($[R_c-R_a]>[R_d-R_b]$) such that the flange of the first element extends between the inner wall and the outer wall of each segment in an interference fit, and wherein the engagement of the inner and outer walls by the first and second elements sets the diameter of the seal means in operative response to changes in diameter of the outer case.

3. The invention as claimed in claim 2 wherein the second element has a flange extending between the inner wall and the outer wall of each segment in an interference fit, the inner wall having a line of sealing contact which engages the flange of the second element, the line having a radius $R_a'$ about the axis of the engine in the installed position and a radius $R_b'$ in the free state, the outer wall having a line of sealing contact which engages the flange of the second element, the line having a radius $R_c'$ about the axis of the engine in the installed position and a radius $R_d'$ in the free state;

wherein the difference between $R_c'$ and $R_a'$ is greater than the difference between $R_d'$ and $R_b'$ ($[R_c'-R_a']>[R_d'-R_b']$).

4. The invention as claimed in claim 1, claim 2 or claim 3 wherein each segment of the outer wall overlaps two adjacent segments of the inner wall and is attached to a single one of said overlapped segments of the inner wall.

5. The invention as claimed in claim 4 wherein each overlapping segment of the outer wall has a center section and the attached segment of the inner wall has a center section attached to a corresponding center section of the outer wall.

6. The invention as claimed in claim 5 which further includes one or more radially extending pins which penetrate said seal means and said support structure to prevent relative rotation therebetween.

7. The invention as claimed in claim 6 which further has a plurality of outer air seals, each engaging the first element and the second element wherein each outer air seal traps the inner wall of each segment between the outer air seal and the first element and between the outer air seal and the second element and applies an outwardly directed force to the inner wall at the first element and the second element and wherein the outer wall of each segment applies an inwardly directed force against the first element and the second element in operative response to the pressure of the cooling air.

* * * * *